United States Patent [19]

Fisher

[11] 4,391,045

[45] Jul. 5, 1983

[54] DRAWING INSTRUMENT OR APPARATUS

[76] Inventor: Denys Fisher, Kirkconnel Lea, Glencaple, Dumfries DG1 4RG, Scotland

[21] Appl. No.: 244,506

[22] Filed: Mar. 16, 1981

[30] Foreign Application Priority Data

Mar. 18, 1980 [GB] United Kingdom ..... 8009084
Sep. 19, 1980 [GB] United Kingdom ..... 8029079

[51] Int. Cl.[3] ..... B43L 11/00
[52] U.S. Cl. ..... 33/27 L
[58] Field of Search ..... 33/27 L, 174 B, 174 G

[56] References Cited

U.S. PATENT DOCUMENTS

| | | | |
|---|---|---|---|
| 1,349,455 | 8/1920 | Henriksen | 33/403 |
| 2,190,071 | 2/1940 | Keppers | 33/403 |
| 3,230,624 | 1/1966 | Fisher | 33/27 L |
| 3,465,445 | 9/1969 | Fisher | 33/27 C |
| 3,900,956 | 8/1975 | Furuoka et al. | 33/174 B |

FOREIGN PATENT DOCUMENTS

| | | | |
|---|---|---|---|
| 1409907 | 7/1965 | France | 33/27 L |
| 1470756 | 1/1967 | France | 33/27 L |

*Primary Examiner*—Harry N. Haroian
*Attorney, Agent, or Firm*—Gene O. Enockson; L. MeRoy Lillehaugen; Stuart R. Peterson

[57] ABSTRACT

A design drawing instrument for creating a variety of decorative patterns and designs. The instrument includes a frame member having a circular opening and a multi-lobed cam-shaped internal recess therein, and a disc member having a multi-lobed cam-shaped external surface or edge. The disc member is provided with stencil-shaped openings in its surface. The disc member is positioned within the recess formed in the frame so that its surface with stencil-shaped openings, is exposed. By placing a writing instrument, such as a pen, within the stencil opening and tracing along the outline of said opening, the disc is caused to move relative to the frame member and a prescribed design is created on a drawing surface.

11 Claims, 18 Drawing Figures

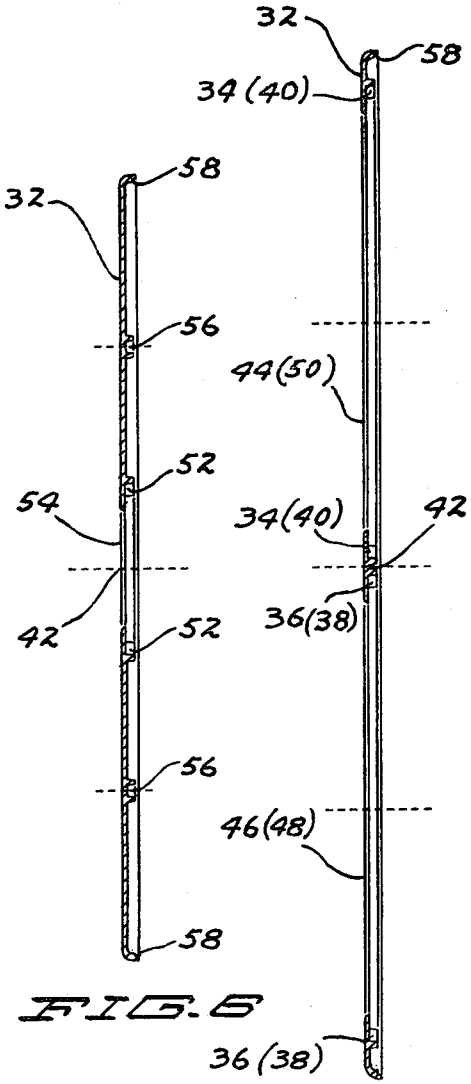
FIG. 6
FIG. 7
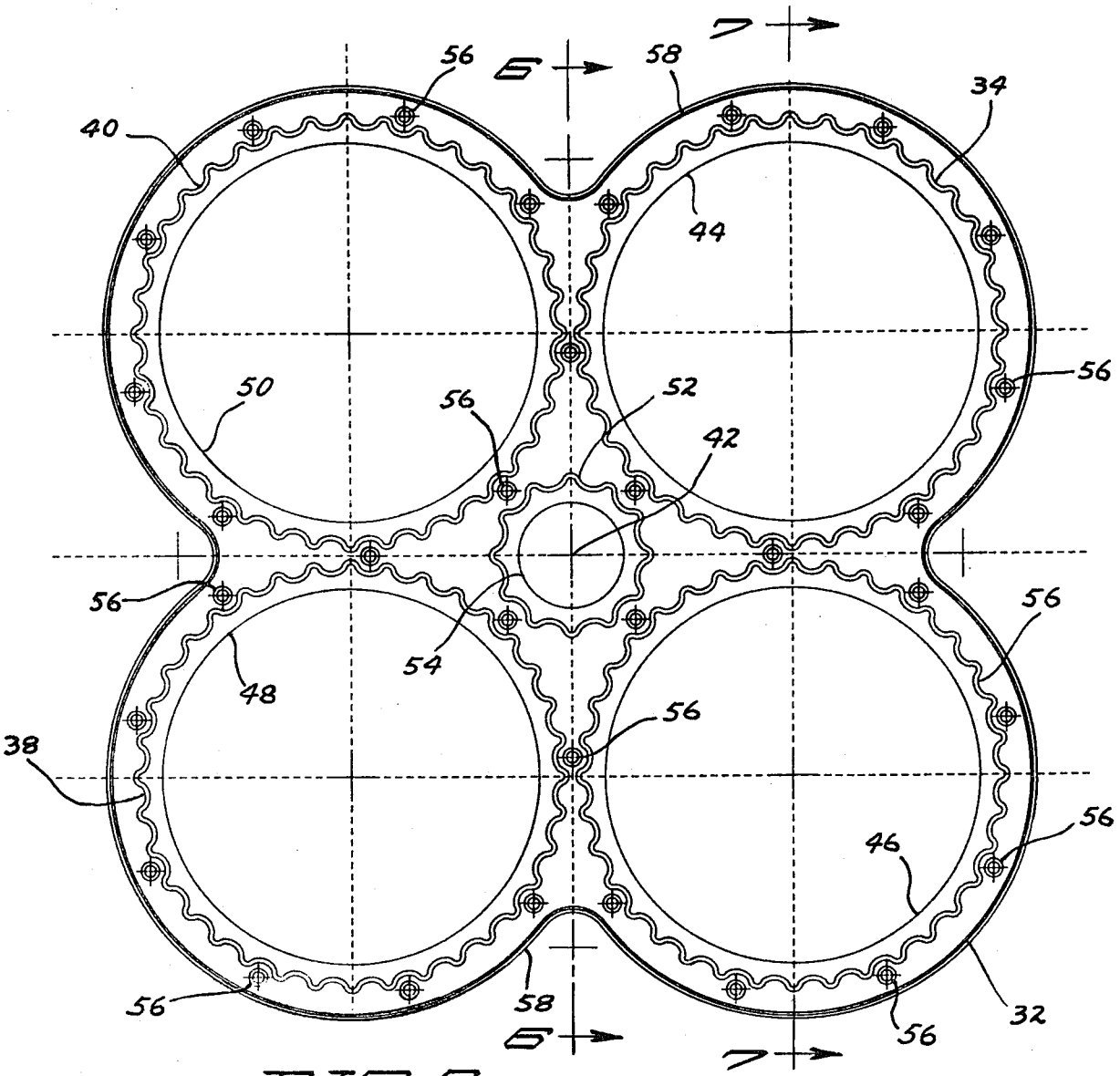
FIG. 5

58
60
32
76
(82)
62(68)
44(50)
34(40)
36(38)
64(66)
46(48)
78(80)
74
52
84
84A
56

DRAWING INSTRUMENT OR APPARATUS

BACKGROUND OF THE INVENTION

The invention relates to drawing instruments or apparatus, and more specifically to drawing instruments intended primarily, but not exclusively for use as a toy by children in the creation of decorative patterns and designs of a varying nature. The invention is equally useful to artists, designers and similar professional persons.

There have been many proposals for drawing instruments or apparatus in the past. One well known drawing instrument involves the use of a toothed ring primary member and a toothed disc secondary member, both ring and disc each having a plurality of holes through which may be projected a pen, pencil or the like, so that the ring and disc may be moved relative to each other by the pen, pencil or the like, with the teeth of the primary and secondary members in mesh, and simultaneously produce a design on a surface supporting the drawing instrument. My U.S. Pat. No. Re. 26,341—Instruments or Apparatus discloses an instrument being marketed as Spirograph® Design Drawing Toy. The holes in the Spirograph® drawing instrument include round holes, of sufficient diameter only to accommodate the tip or writing point of a pen, pencil or the like, so that a design produced on the surface supporting the instrument when the pen, pencil or the like is engaged in a hole and is moved to cause relative movement between the two members, results only from such relative movement, the design produced not being dependent upon the shape of the hole. Thus restraints are inherent in the apparatus, and only designs in the epicyclic range are possible with the drawing instrument disclosed in this patent.

It has been discovered that the teeth of the primary member and the secondary member of the above described drawing instruments are prone to accidental disengagement, particularly by children, and difficulty is ofttimes experienced by children in maintaining the teeth of the primary and secondary members in mesh during operation of the instrument, so that very often a design is spoiled by the teeth of the primary and secondary members coming out of mesh.

SUMMARY OF THE INVENTION

The present invention seeks to provide an improved form of drawing instrument or apparatus which does not suffer the disadvantages and limitations of the above-described apparatus, and accordingly the invention provides a drawing instrument in the form of a self-indexing stencil comprising a conjugated cam system consisting of a first member having a multi-lobed cam-shaped surface, and a second member having a multi-lobed cam-shaped surface, said first member having one or more shaped apertures therein, whereby when an, or the, aperture shape in said first member is completely traced out by a pen, pencil or the like, engaging the surface of the aperture, said first member is indexed one part of one revolution relative to said second member, said one part being dependent upon the number of lobes on said cam-shaped surfaces, said pen, pencil or the like simultaneously drawing or inscribing a design upon a surface supporting the drawing instrument.

Preferably, said first member will be a disc having a multi-lobed cam-shaped external surface, and said second member will be a frame having a multi-lobed cam-shaped internal surface.

The size of the disc relative to the internal surface of the frame will be such that the mating surfaces will always be in engagement with each other.

The number of lobes on the external cam-shaped surface of the disc will be one less than the number of lobes on the internal cam-shaped surface of the frame, the pitch and size of the lobes being dependent upon the amount of relative indexing required when a, or the, shaped aperture is completely traced out by a pen, pencil or the like.

In its simplest form the apparatus will include one conjugated cam system consisting of one first member in the form of a disc having a multi-lobed cam-shaped external surface, and one or more apertures therein, and one second member in the form of a frame having a multi-lobed cam-shaped internal surface. The said second member will preferably be constituted by two opposed plate-like members between which is located the first member, the plate-like members having opposed openings so as to afford access to the first member and being secured together so as to maintain the multi-lobed cam-shaped surfaces in mesh, the first member being movable relative to and between the said plate-like members.

The first member will preferably be transparent or translucent so that the design produced can be viewed through the first member.

In a particularly preferred form of the invention, the drawing instrument will consist of a plurality of conjugated cam systems each including a multi-lobed cam-shaped external surface and a multi-lobed cam-shaped internal surface. The multi-lobed cam-shaped external surfaces will be located on first members of the conjugated cam systems, said first members each being in the form of a disc having a plurality of shaped apertures. The plurality of conjugated cam systems will preferably be five.

The plurality of conjugated cam systems will preferably be constituted by a plurality of first members each having a muli-lobed cam-shaped external surface and a common second member having a corresponding plurality of multi-lobed cam-shaped internal surfaces, said second member being constituted by opposed plate-like members having a corresponding plurality of openings so as to afford access to said first members.

The first and second members will be composed of synthetic plastic material, the first members preferably being transparent or translucent.

The outer planar surface of at least one of the plate-like members may be provided with a coating of one or more areas of a friction material such as rubber or similar material so as to prevent sliding of the apparatus on the supporting surface.

BRIEF DESCRIPTION OF THE DRAWINGS

The invention will best be understood by reference to the accompanying drawings, wherein:

FIG. 5 is a top plan view of a component of the drawing instrument in its preferred form;

FIG. 6 is a cross-sectional view taken along line 6—6 of FIG. 5;

FIG. 11 is a top plan view of additional components of the drawing instrument in its preferred form;

FIG. 14 is a top plan view of all the assembled components shown in FIGS. 5 to 13;

FIG. 15 is a cross-sectional view as taken along line 15—15 of FIG. 14;

FIG. 16 is a cross-sectional view as taken along line 16—16 of FIG. 14; and

DESCRIPTION OF THE PREFERRED EMBODIMENT

Figure 2:
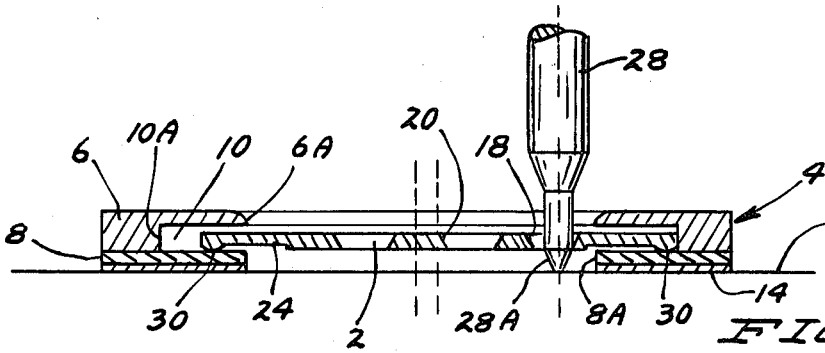
FIG. 2 is a cross-sectional view taken along line 2—2 of FIG. 1.
Figure 1:
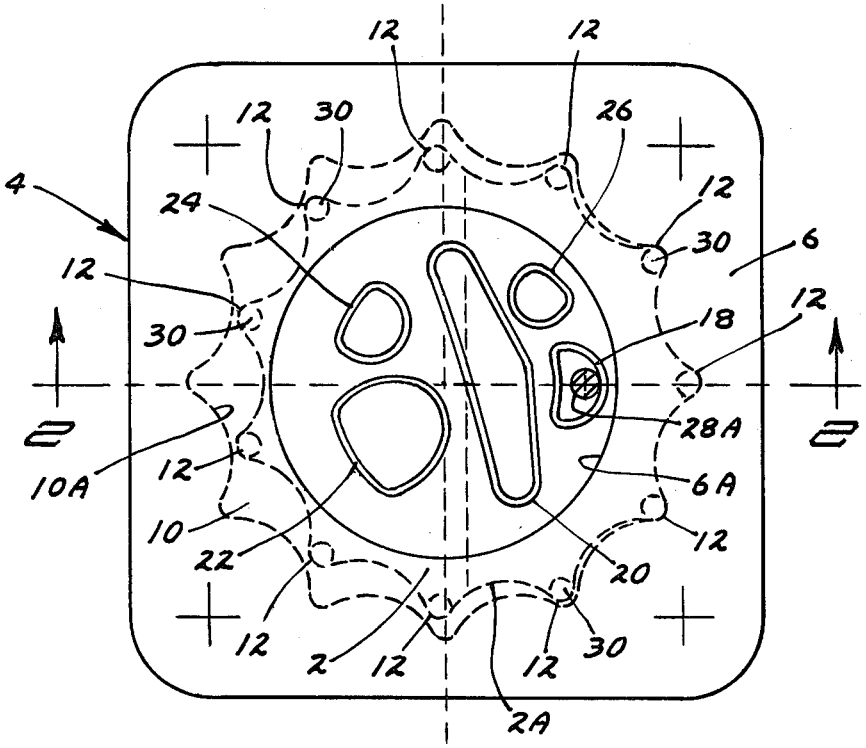
FIG. 1 is a top plan view of a drawing instrument or apparatus according to the invention, which illustrates the apparatus in its simplest form.

Reference is made to the drawings, and firstly to FIGS. 1 and 2. The drawing instrument shown includes a first member in the form of a disc 2 having a surface or edge 2A, and a second member in the form of a frame designated generally by reference numeral 4. As can be seen from FIG. 2, the frame 4 is formed from opposed rectangularly-shaped plate-like members 6 and 8; the plate-like members 6 and 8 together defining a recess 10 therebetween in which is located the disc 2, the disc 2 being held captive, but movable, within the recess 10. Each plate-like member 6 and 8 has a circular opening therein, said openings being referenced by numerals 6A and 8A respectively.

As can be seen from FIG. 1, the surface or edge 10A of the recess 10, is a multi-lobed cam-shaped surface. In a like manner, the external surface or edge 2A of the disc 2 is also a multi-lobed cam-shaped surface; said two surfaces co-acting with one another, to form a conjugated cam system. As will be apparent from the drawings, the number of lobes on the cam-shaped surface 2A is one less than the number of lobes on the cam-shaped surface 10A, so that point contact of the cam surfaces is possible on all lobes, these points of contact being indicated by reference numeral 12. Such multiple contact ensures that the disc 2 cannot get out of "mesh", or wedge in a locked position with the surface 10A of the recess 10.

The plate-like members (also referred to herein as plates) 6 and 8 are preferably, but not necessarily, formed of an opaque plastic material, and the disc 2 is preferably formed of a transparent or translucent plastic material. The lower surface of the plate 8 is covered with a thin film layer 14 of rubber, or other friction material, so that the writing instrument can be held stationary with ease, to prevent slipping with respect to surface 16 which supports the instrument, said surface 16, for example, being a sheet of paper. The layer 14 obviates the need for fastening pins or the like.

In order to prevent flat-plate adhesion between the disc 2 and the base member 8, the disc 2 is provided with downwardly extending dome-shaped elements or protrusions 30 which bear upon the base member 8.

The disc 2 has a plurality of stencil-shaped apertures or openings 18, 20, 22, 24, and 26, which are capable of receiving the tip 28A of a hand-held writing instrument 28 such as a pen, pencil or the like, which projects through the opening 8A of the plate-like member 8 so as to be in contact with the supporting surface 16. The writing instrument 28 serves to move the disc 2 relative to the frame 4, and simultaneously draws or inscribes a design upon the supporting surface 16. The movement of the disc 2 and the simultaneous production of a design on the supporting surface is achieved as follows.

The slight pressure of the tip 28A of the writing instrument 28 acting inside the stencil-shaped aperture, for example that indicated by reference numeral 18, produces contact between the surface or edge 2A of the disc 2, and the surface or edge 10A of the recess 10, at a point in line with the direction of this pressure, this line being at a right angle to the shape of the stencil-shaped aperture, at the point being touched by the tip 28A of the writing instrument 28. After one traverse round the stencil-shaped aperture 18, i.e., after the stencil-shaped aperture has been completely traced out and the tip 28A has returned to its starting point within the stencil-shaped aperture, this line of pressure will have turned through one complete turn. In effect, the lobes of the cam-shaped surface 2A of the disc 2 will have been progressively pushed into the matching lobes of the cam-shaped surface 10A, and the disc 2 will have turned through 360 degrees divided by the number of lobes on the cam-shaped surface 10A. In this way, the disc 2 is automatically indexed, as the writing instrument 28 is moved around the surface of the stencil-shaped aperture. After the writing instrument 28 has been moved around the surface of the stencil-shaped aperture by as many times as there are lobes on the cam-shaped surface 10A, the writing instrument and the disc 2 will have returned to the original starting points relative to the frame 4 and the surface 16 on which the design is being produced; at this point, the design will be finished.

Figure 3:
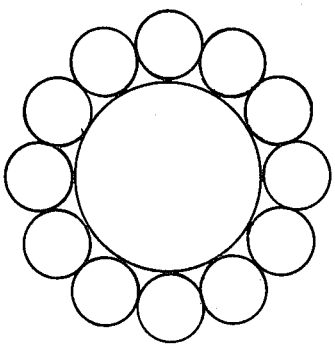

By computation, it is possible to determine the right shapes of the stencil-shaped apertures to give specifc and predetermined finished designs, if such designs are theoretically possible. For example, the shape of the stencil-shaped aperture 18 has been computed to produce the finished design shown in FIG. 3, which consists of twelve circles surrounding a larger circle. In this particular case a slight deformation of the smaller circles of the design is theoretically inevitable, but this could be avoided by increasing the diameter of these circles to a calculable value.

Figure 4:
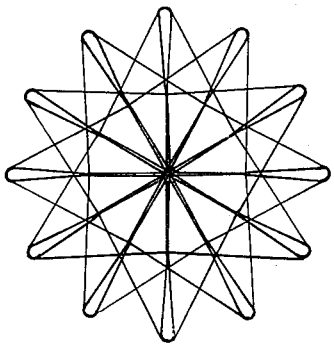
FIGS. 3 and 4 show a design produced when a writing or drawing instrument such as a pen, pencil or the like, is used in certain of the apertures shown in FIG. 1.

A further example of a finished design is shown in FIG. 4, which is produced by the stencil-shaped aperture 20 of the disc 2.

The movement of the disc 2 by the tip 28A of the writing instrument 28 relative to the frame 4 will, it should be appreciated, be in the opposite sense to the manner in which the writing instrument 28 is being moved, i.e., when the writing instrument 28 is moved in a clockwise direction, the disc 2 will be moved in a counter-clockwise direction and vice versa.

Having described the basic construction and principles of operation, of a drawing instrument according to the invention, a preferred embodiment of the invention will now be described with specific reference to FIGS. 5 to 16 of the drawings.

Figure 7S:
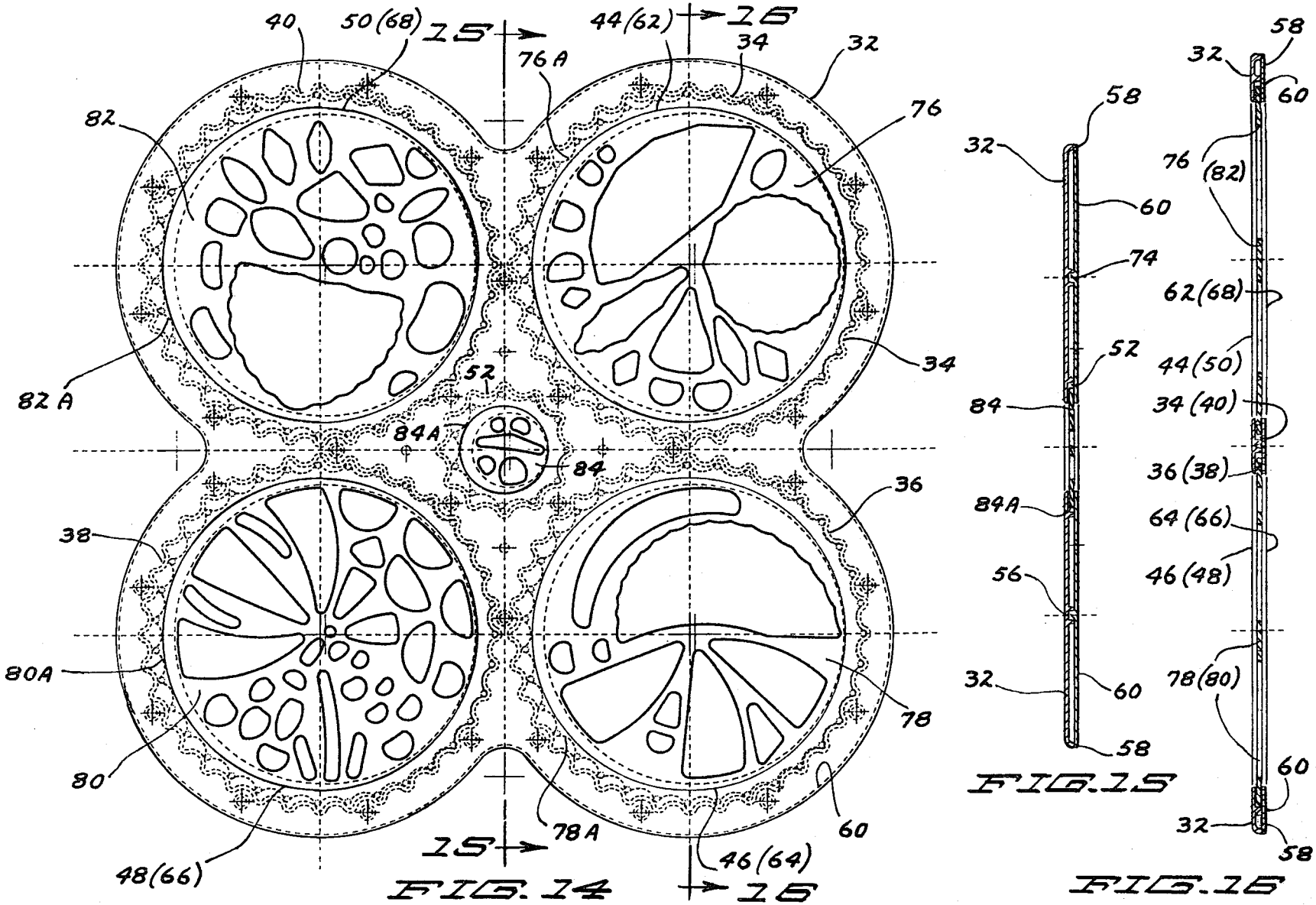
FIG. 7 is a cross-sectional view of the drawing instrument as taken along line 7—7 of FIG. 5.

Reference is first made to FIGS 5 to 10, which disclose a frame equivalent to the frame 4 of FIGS. 1 and 2. The frame is comprised of a plate-like member 32 (FIGS. 5 to 7) and a plate-like base member 60 (FIGS. 8 to 10); the complete frame being shown in FIGS. 14 to 16. The plate member 32 of FIGS. 5 to 7 is formed from a shaped plate-like member having a plurality of multi-lobed cam-shaped surfaces 34, 36, 38, and 40, which are spaced equidistantly from a theoretical center point 42 of the plate member, and located about respective openings 44, 46, 48, and 50 of the plate member. In addition, a multi-lobed cam-shaped surface 52 is provided, which is located symmetrically about the theoretical axis 42, and it includes an opening 54 at the center of the plate member 32. The cam-shaped surface 52 and the opening 54 are equi-spaced from the cam-shaped surfaces 34, 36, 38, and 40, and from the openings 44, 46, 48 and 50. The cam-shaped surfaces are raised from the planar surface of the member 32.

The plate member 32, is preferably formed of an opaque plastic material, it has a plurality of recessed bosses 56, and its peripherry is flanged as indicated by reference numerals 58.

Figure 10:
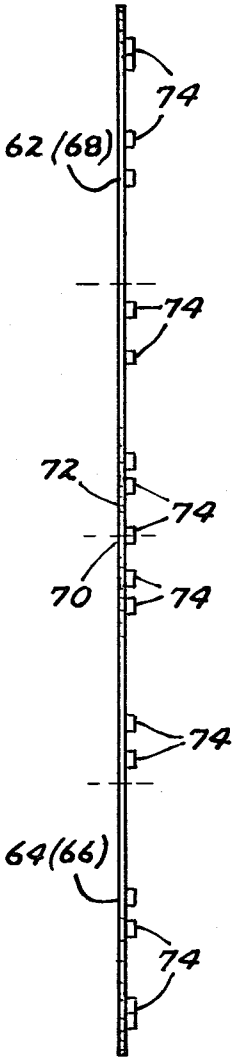
FIG. 10 is a side view as taken along line 10—10 of FIG. 8.
Figure 9:
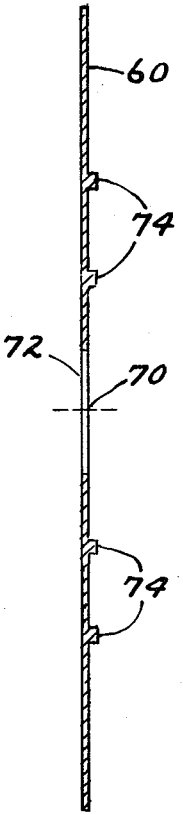
FIG. 9 is a cross-sectional view taken line 9—9 of FIG. 8.
Figure 8:
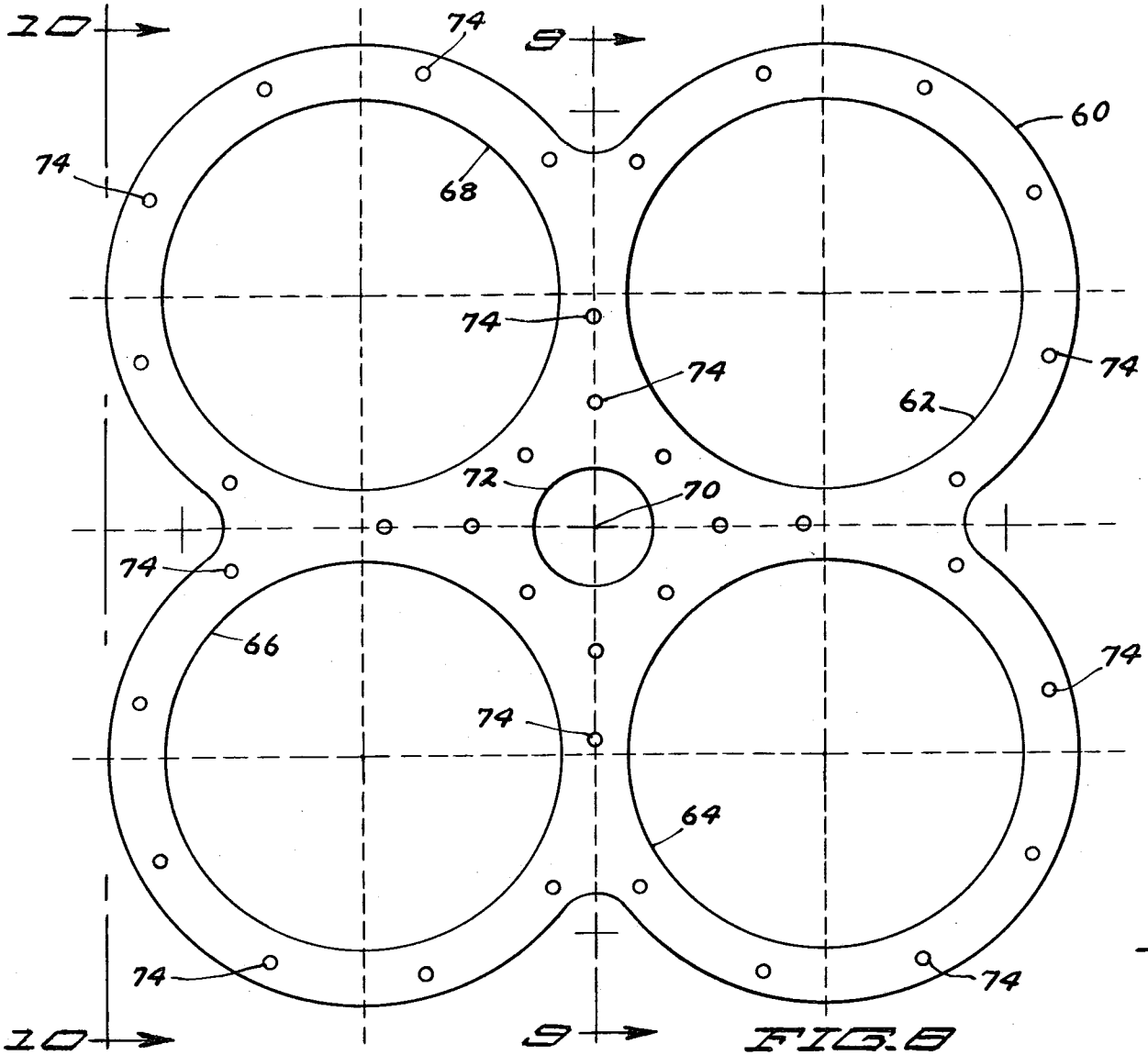
FIG. 8 is a top plan view of another component of the drawing instrument in its preferred form.

The plate-like base member 60, as illustrated in FIGS. 8 to 10, consists of a shaped plate—which shape corresponds to the shape of the plate member 32—having four openings 62, 64, 66 and 68 spaced equidistantly from a theoretical center point 70 of the plate, and an opening 72 located symmetrically about said center point 70 and equi-spaced from the four openings 62, 64, 66 and 68. The base plate 60 further has a plurality of protruding pegs 74, the positioning of the pegs 74 corresponding to the positions of the recessed bosses 56 of the plate member 32, and the positions of the openings 62, 64, 66, 68, and 72 corresponding to the positions of the openings 44, 46 , 48, 50 and 54 in the plate member 32, so that said openings are in register when the apparatus is assembled with the pegs 74 located in and gripped by the recessed bosses 56. The outer planar surface of the base member 60 will preferably have a coating or film layer of rubber or other friction material similar to that shown and described in conjunction with FIG. 2

The base member 60 is preferably formed of an opaque plastic material, similar to that of the plate member 32. The overall dimension of the base member 60 is slightly smaller than the overall dimension of the plate member 32, such that the base member 60 may fit within the flange 58 of the plate member 32, when the apparatus is in assembled condition.

Figures 12, 13, 22:
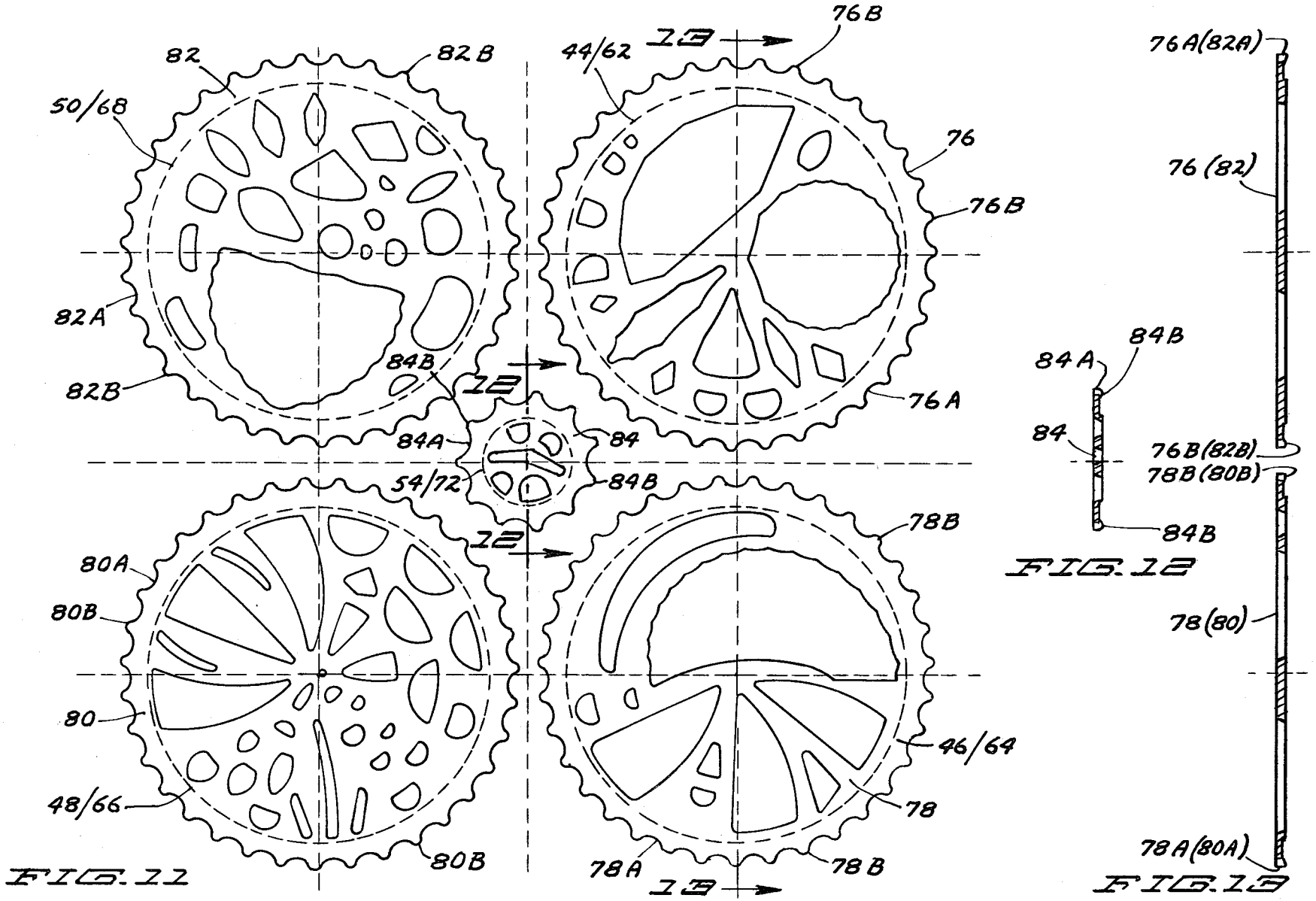
FIG. 12 is a cross-sectional view taken along line 12—12 of FIG. 11.
FIG. 13 is a cross-sectional view as taken along line 13—13 of FIG. 11.

Reference is now made to FIGS. 11 to 13, which show a plurality of discs for location between, and co-operation with the members 32 and 60 of the frame, i.e., within a recess formed by the members 32 and 60. There are four large discs 76, 78, 80 and 82, and a small disc 84, and it will be appreciated that the arrangement of these discs is such that their positions correspond to the positions of the openings in the members 32 and 60, these positions being indicated by the dotted lines referenced 44/62, 46/64, 48/66, 50/68, and 54/72. Each of the discs 76, 78, 80, 82 and 84 has a multi-lobed cam-shaped surface 76A, 78A, 80A, 82A and 84A respectively, the number of lobes on these cam-shaped surfaces being one less than the number of lobes on their co-acting cam-shaped surfaces 34, 36, 38, 40 and 52 of the frame. In the particular embodiment illustrated, the number of lobes on the cam-shaped surfaces 76A, 78A, 80A and 82A are equal, but it will be appreciated that the number of lobes on these surfaces could differ, provided that the number of lobes on their respective co-acting cam-shaped surfaces 34, 36, 38 and 40, differed accordingly.

Each disc has a plurality of shaped stencil-like apertures or openings, and each disc has a plurality of generally dome-shaped elements or protrusions 76B, 78B, 80B, 82B, and 84B respectively, to prevent flat-plate adhesion as previously referred to. The discs are preferably formed of a transparent or translucent plastic material.

FIGS. 14 to 16 show the components of FIGS. 5 to 13 in their assembled condition. The plate-like base member 60 is located within the flange 58 of the plate member 32 with the discs 76, 68, 80, 82 and 84 located in the recess between the members 32 and 60, the plate members 32 and 60 being secured together so as to retain the discs in position by interaction between the recessed bosses 56 and the protruding pegs 74. As will be seen, the multi-lobed cam-shaped surfaces of the discs and frame are in interengagement and cannot come out of this engagement due to the discs being sandwiched between the members 32 and 60. If preferred, or course, the instrument could be constructed so that the discs could be removed and interchanged.

It is not thought necessary to further describe the operation of the apparatus shown in FIGS. 14 to 16, since the operation is as previously described with reference to the apparatus illustrated in FIGS. 1 and 2. It will probably have been appreciated that the disc 2 of FIG. 1 is the same as the disc 84 of FIGS. 11 to 14, to a larger scale. Operation of the discs 76, 78, 80 and 82 is identical to the previously described operation.

Figure 17:
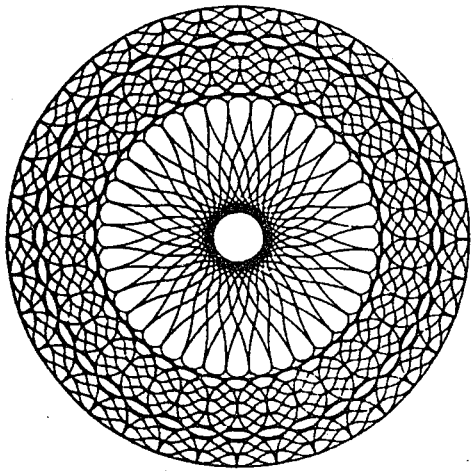
FIGS. 17 and 18 show examples of designs produced by operation of the assembled instrument of FIG. 14.

The stencil-shaped apertures or openings in any one of the discs are computed so that a composite design can be drawn using several of the shaped apertures which are compatible with each other. Such a composite design is shown in FIG. 17.

Figure 18:
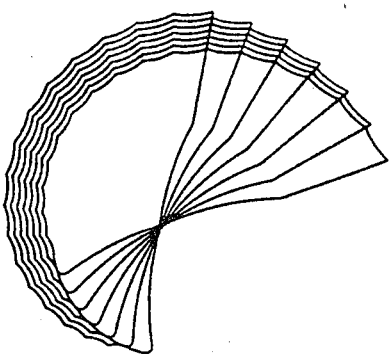

It is not necessary to complete a design, and in many cases an attractive design or shape is produced after a limited number of indexed movements of the disc has been made. Such a shape or design is shown in FIG. 18.

Also, by suitably arranging and formulating the shaped apertures in the disc, specific patterns and configurations such as faces, animals and so on, may be produced upon the surface supporting the drawing apparatus.

With apparatus according to the invention, the design produced on the surface supporting the drawing apparatus, is a combination of the shape of the aperture in the disc and the movement of the disc relative to the frame. Drawing apparatus according to the invention has the simplicity of use of a conventional stencil, but has the advantages firstly that the stencil moves automatically as the pen, pencil or the like, is moved by hand in the shaped aperture, and secondly that of producing accurate and intricate designs of interest and appeal. In addition, the provision of the thin film of rubber or other friction material, enables the drawing apparatus to be used without the need for fastening pins or the like, which is an advantage when the apparatus is to be used by young children. Moreover, the self-contained design and construction of the apparatus ensures that parts cannot be lost or misplaced, as can happen with other forms of drawing apparatus.

It will be appreciated that modifications may be made to drawing apparatus embodying the invention. For example, the number of conjugated cam systems in the drawing apparatus may be more or less than disclosed in the preferred embodiment. Moreover, the shape of the apertures and of the drawing apparatus itself, may vary from those disclosed, as could the number of lobes on the conjugated cam systems.

In addition, the multi-lobed cam-shaped surface(s) of the frame might be formed on separate ring-shaped members which could be inserted into recessed areas in the plate-like members of the frame, so that the ring-shaped members would be immovable relative to the frame. Or the multi-lobed cam-shaped surfaces(s) of the frame could be formed by two mating plates, these plates being identical and each incorporating one-half of the cam-shaped surfaces.

In the above description and attached drawings, a disclosure of the principles of the invention is presented, together with specific embodiments by which the invention might be carried out.

Now, therefore, I claim:

1. A self-indexing design drawing apparatus comprising a first member having a first substantially circular multi-lobed cam-shaped surface formed with a first number of identical angularly spaced outwardly projecting lobes, a second member having a second substantially circular multi-lobed cam-shaped surface formed with a second number of identical angularly spaced inwardly projecting lobes having notches therebetween, said first number being one less than said second number and the size and shape of said first lobes being correlated with the size and shape of said notches so that said first lobes engage and interfit in said notches between said second lobes, means for joining said first and second members together so that contact can be produced between successive portions of said cam-shaped surfaces, said first and second members being movable relative to each other, the size of said surfaces with respect to each other being such that when one of said lobes on said first member is fully received or engaged in one notch between two adjacent lobes on said second member there is a slight clearance between the lobe on said first member located substantially opposite said one lobe, said slight clearance being less than the distance said first lobes project from said first member and only sufficient to permit angular movement of said opposite lobe relative to the nearest lobe on said second member while said one lobe is fully received or engaged in said one notch between said two adjacent lobes on said second member, said first member having at least one shaped opening therein, whereby a design can be formed on a surface by tracing the opening shape in said first member with a writing instrument by engaging the edge of said opening and moving said instrument within said opening in one direction while engaging said edge, said first member having indexed one part of one revolution in an opposite direction with respect to said second member each time that the opening in the first member is traced.

2. The combination of claim 1 wherein said first member is a disc having said first multi-lobed cam-shaped surface externally disposed thereon, and said second member is a frame having said second multi-lobed cam-shaped surface internally disposed thereon.

3. The combination of claim 2 wherein said frame is provided with a recess which forms the multi-lobed cam-shaped internal surface, said disc being positioned within said recess and being movable relative thereto.

4. The combination of claim 2 wherein said frame is formed from a plate member having a circular opening, and a recess forming the multi-lobed cam-shaped internal surface.

5. The combination of claim 2 wherein the pitch and size of said lobes is dependent upon the amount of relative indexing required when a shaped opening is traced.

6. The combination of claim 2 wherein said disc is formed from a transparent or translucent material, said disc having a number of differently shaped openings therein, whereby different designs can be formed on a surface by tracing the edges of said openings.

7. The combination of claim 2 wherein means are provided on the bottom surface of said frame for preventing said frame from slipping with respect to a surface on which it is positioned.

8. The combination of claim 7 wherein said means is a layer of friction material, and means for adhering said layer to the frame surface.

9. The combination of claim 4 wherein said disc is provided with a plurality of protrusions on its bottom surface for preventing flat-plate adhesion between said disc and the surface of the recess.

10. A self-indexing design drawing apparatus which includes a conjugated cam system comprising a first member in the form of a disc having a multi-lobed cam-shaped external surface formed with a first number of identical angularly spaced outwardly projecting lobes, the outermost end portions of said outwardly projecting lobes residing generally in a circle having a certain first diameter, said disc having at least one stencil-shaped opening with a prescribed noncircular shape, a frame member formed by a pair of plate-like members, at least one of said plate-like members provided with a circular opening having a certain second diameter and at least one of said plate-like members including a multi-lobed cam-shaped recess formed with a second number of identical angularly spaced inwardly projecting lobes providing an internal surface having a notch between each pair of inwardly projecting lobes, the outwardly projecting lobes being of a shape and size so as to be engageable in the notches between said inwardly projecting lobes, the innermost end portions of said inwardly projecting lobes residing generally in a circle having a certain third diameter and the number of said outwardly projecting lobes being one less than the number of said inwardly projecting lobes, means for joining said plate-like members together so that said recess is formed between them, means for positioning said disc within said recess said first and third diameters being larger than said second diameter so that said disc is held captive in said recess and said first diameter being sufficiently larger than said third diameter so that when one outwardly projecting lobe on said disc is fully engaged in one notch between adjacent inwardly projecting lobes on said one plate-like member a second of said outwardly projecting lobes located generally diametrically opposite said one outwardly projecting lobe on said disc can be angularly moved relative to the nearest inwardly projecting lobe on said one plate-like member and then radially moved into engagement with the notch between said nearest inwardly projecting lobe and the next adjacent inwardly projecting lobe on said one plate-like member, and means engageable with the edge of said stencil-shaped opening for moving said disc relative to said frame as said means is moved within said stencil-shaped opening while in pressural engagement with the edge thereof.

11. A drawing apparatus comprising co-operating first and second members, said first member being a generally circular disc having a first multi-lobed cam-shaped surface formed with identical angularly spaced lobes projecting radially outward and said second member being a frame member with a generally circular opening therein having a second multi-lobed cam-shaped surface spaced outwardly from said generally circular opening and formed with identical angularly spaced lobes projecting radially inwardly and having notches therebetween, said first and second surfaces providing co-operating surfaces which constitute a conjugated cam system such that said disc is in rolling circular contact with said second surface, said outwardly projecting lobes being of a size and shape so as to engage and interfit in the notches between said inwardly projecting lobes, said disc having one or more shaped apertures therein, the effective diameter of the theoretical rolling circle of said disc being less than the effective diameter of the theoretical rolling circle formed by said circular opening only by an amount such that when one of said outwardly projecting lobes on said disc is fully engaged in one of the notches between two adjacent inwardly projecting lobes on said frame a generally oppositely located outwardly projecting lobe on said disc is out of engagement with the two nearest inwardly projecting lobes, and when said generally oppositely located outwardly projecting lobe is engaged in the notch between said two nearest inwardly projecting lobes, then said one outwardly projecting lobe is completely out of engagement with said first-mentioned adjacent inwardly projecting lobes to enable the apparatus to act as a self-indexing stencil.

* * * * *